United States Patent [19]

Shimada et al.

[11] 4,308,516

[45] Dec. 29, 1981

[54] PLUG-IN FUSE ASSEMBLY

[75] Inventors: Yukio Shimada, Yokohama; Syuichi Otani, Tokyo; Susumu Hashimoto, Saitama; Michio Kasamatsu, Sakado; Teruo Suda, Chiba; Noriyasu Saito, Abiko, all of Japan

[73] Assignee: Nissan Motor Company, Limited, Kanagawa, Japan

[21] Appl. No.: 122,871

[22] Filed: Feb. 19, 1980

[30] Foreign Application Priority Data

Feb. 19, 1979 [JP] Japan ..... 54-19063[U]
Feb. 19, 1979 [JP] Japan ..... 54-19064[U]
Feb. 19, 1979 [JP] Japan ..... 54-19065[U]

[51] Int. Cl.[3] ..... H01H 85/30
[52] U.S. Cl. ..... 337/241; 337/265
[58] Field of Search ..... 337/206, 241, 242, 243, 337/244, 265, 266, 267

[56] References Cited

U.S. PATENT DOCUMENTS 2,702,329 2/1955 Dietz, Jr. et al. ..... 337/265
3,924,216 12/1975 Martin et al. ..... 337/206
4,127,837 11/1978 Borchart ..... 337/243 X

FOREIGN PATENT DOCUMENTS 2722008 11/1978 Fed. Rep. of Germany ..... 337/265

*Primary Examiner*—George Harris
*Attorney, Agent, or Firm*—Lowe, King, Price & Becker

[57] ABSTRACT

A plug-in fuse assembly is disclosed which includes a fuse element made up of a pair of elongated current-carrying portions in spaced relationship and a fuse-forming link portion extending between the current-carrying portions. The fuse element is placed in an insulating casing with its terminal portions projecting therefrom. Means is provided for providing a fuse opening indication in response to heat generated from the fuse-forming link portion when it opens up.

3 Claims, 6 Drawing Figures

PLUG-IN FUSE ASSEMBLY

BACKGROUND OF THE INVENTION

1. Field of the Invention

This invention relates to improvements in a plug-in fuse assembly and, more particularly, to a plug-in fuse assembly which provides an indication to the user when the fuse opens up.

2. Description of the Prior Art

Plug-in fuse assemblies have been widely accepted by virtue of their great potential for compact and inexpensive designs. For example, U.S. Pat. No. 3,909,767, to Williamson et al. issued Sept. 30, 1975 shows and describes in plug-in fuse assembly.

As illustrated in perspective form in FIG. 1, such a conventional plug-in assembly comprises a fuse element 1 stamped from a strip of fuse metal, and a synthetic plastic molded casing 2 with a space therein in which the fuse element 1 is placed. The fuse element 1 is comprised of a pair of elongated current-carrying portions 3 projecting in spaced parallel relationship from the bottom margin of the casing 2 and a fuse-forming link portion 4 extending between the current-carrying portion 3 to interconnect them. The top ends 5 of the current carrying portions 3 are exposed so that test probes can contact with the current carrying portions 3.

One of the difficulties with such a conventional plug-in fuse assembly is that testing means and troublesome manipulations are required in testing for the continuity of the fuse-forming link portion.

SUMMARY OF THE INVENTION

In view of the foregoing, a general object of the present invention is to provide an improved plug-in fuse assembly which permits the user to check the continuity of the fuse with greater ease.

Another object of the present invention is to provide an improved plug-in fuse assembly which can provide an indication when the fuse opens up.

BRIEF DESCRIPTION OF THE DRAWINGS

For a better understanding of the present invention, as well as other objects and features thereof, reference is had to the following detailed description of the invention to be read in connection with the accompanying drawings, wherein.

DESCRIPTION OF THE PREFERRED EMBODIMENTS

Figure 1:
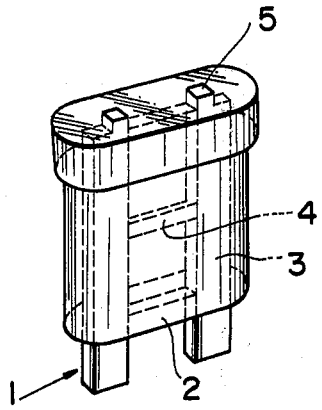
FIG.1 (PRIOR ART)
FIG. 1 is a transparent view showing a conventional plug-in fuse assembly.
Figure 3:
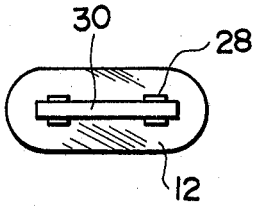
FIG. 3 is a top plan view of the fuse assembly of FIG. 2.
Figure 2:
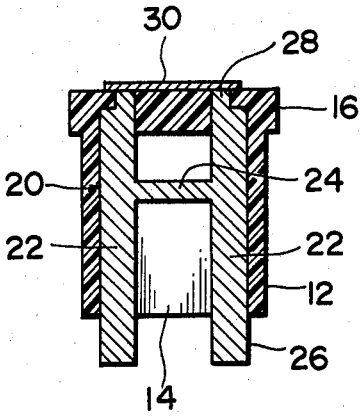
FIG. 2 is a longitudinal sectional view showing one embodiment of a plug-in fuse assembly made in accordance with the present invention.
Figure 4:
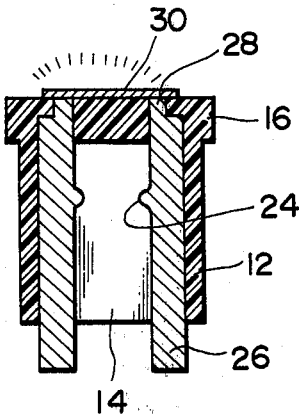
FIG. 4 is a longitudinal sectional view of the fuse assembly of FIG. 2 showing the condition of opening of the fuse-forming link portion.

Referring now to FIGS. 2 to 4, there is illustrated one embodiment of a plug-in fuse assembly made in accordance with the present invention. The plug-in fuse assembly comprises an insulating casing 12 formed therein with a cavity 14 opening at its bottom end and having its top wall 16 provided with through-holes 18. The casing 12 may be a molded part made of an insulating material such for example as vinyl chloride.

The plug-in fuse assembly also comprises a fuse element 20 which is made up of a pair of elongated current-carrying portions 22 in spaced parallel relationship and a fuse-forming link portion 24 extending between the current-carrying portions 18 to interconnect them. The fuse-forming link portion 24 is preferably both narrower in width and smaller in thickness than the current-carrying portions 22 of the plug-in fuse element 20 so that it can open up with heat generation if an excessive flow of electric current is conducted therethrough. The plug-in fuse element 20 may be a single stamping from a strip of fuse metal such for example as a zinc alloy. The fuse element 20 is inserted into the cavity 14 of the casing 12 through its bottom opening and placed therein with the current-carrying portions 22 having their terminal portions 26 projecting outwardly from the bottom margin of the casing 12 and having their top end portions 28 extending through the holes 18 of the casing 12.

A high-resistance, heat-responsive member 30 is placed on the outer surface of the top wall 28 of the casing 12 in electrical contact with the top ends of the current-carrying portions 22. The high-resistance, heat-responsive member 30 may be a high-resistance metal plate having on its surface a heat responsive coat, a heat responsive semiconductor film or layer, or the like having a high resistance with its color changed when exposed to high temperature. The high responsive material is preferably of the type having a property to maintain the color changed after it is once changed.

In view of minimization of the shunt current flow through the member 30 when the fuse is closed and great circuit protection when the fuse opens up, the resistance of the high-resistance, heat-responsive member 30 is preferably selected at 50 or more times the resistance of the fuse-forming link portion 24.

With the plug-in fuse assembly of this embodiment, if the fuse-forming link portions 24 of the fuse elemment 20 is exposed to an excessive flow of current, it will open up and the current flow through the high-resistance, heat-responsive member 30 to heat it and change the color thereof as shown in FIG. 4. This provides a fuse opening indication to the user.

Figure 5:
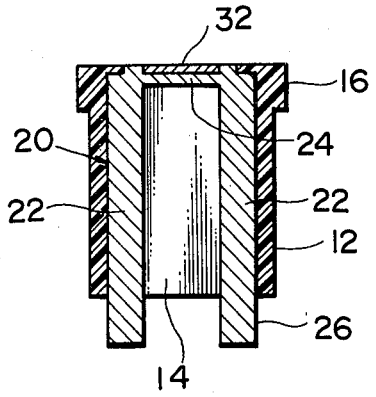
FIG. 5 is a longitudinal sectional view showing a second embodiment of the present invention.

Referring to FIG. 5, there is illustrated a second embodiment of the present invention wherein like parts are designated by like reference numerals. In this embodiment, the insulating casing 12 is formed of thermoplastic resin such for example as vinyl chloride and has its top wall 16 thinned at least partially. The fuse-forming link portion 24 of the fuse element 20 is positioned near the top wall 16 of the casing 12.

With this arrangement, if there is an excessive flow of current through the fuse-forming link portion 24, it will open up with generating heat to deform or brake the thinned portion of the of the top wall 16. This can be viewed by the user.

It is preferable to deposit, on the outer surface of the top wall 16 of the casing 12, a heat responsive film 32 which has its color changed when exposed to high temperature. This provides a more reliable fuse opening indication to the user. The heat responsive film is preferably of the type having a property to maintain the color changed after it is once changed. The deposition of the heat responsive film may be accomplished by coating a heat responsive material.

Figure 6:
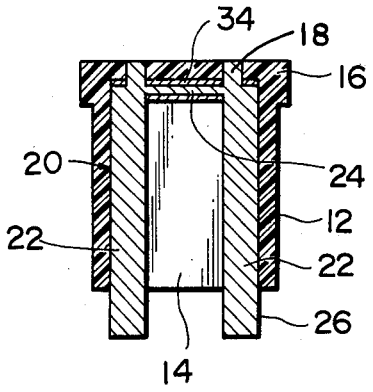
FIG. 6 is a longitudinal sectional view showing a third embodiment of the present invention.

Referring to FIG. 6, there is illustrated a third embodiment of the present invention wherein like parts are designated by like reference numerals. In this embodiment, the casing 12 is formed of an insulating material high in transparency and a heat responsive film 34 is deposited, such as by coating, on at least a part of the surface of the fuse-forming link portion 24 of the fuse element 20. The heat responsive film 34 has its color changed when exposed to high temperature and preferably has a property to maintain the color changed after it is once changed.

With this arrangement, the fuse-forming link portion 24 opens up with generating heat to change the color of the heat responsive film 34 deposited thereon when exposed to an excessive flow of current. This can be viewed by the user through the transparent casing 12.

It is to be noted, of course, that the heat responsive film 34 may be deposited on the whole surface of the fuse element 20.

In view of the foregoing, it is apparent that there has been provided, in accordance with the present invention, an improved plug-in fuse assembly which provide a fuse opening indication which the user can note with ease. While this invention has been described in conjunction with specfic embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. A plug-in fuse assembly comprising:

(a) an insulating casing formed therein with a cavity;

(b) a fuse element placed in said cavity of said casing, said fuse element made up of a pair of elongated current-carrying portions in spaced relationship, and a fuse-forming link portion extending between said current-carrying portions, said current-carrying portions having their bottom end portions extending from the bottom margin of said casing and their top end portions extending through the top wall of said casing; and (c) a resistance member placed on the outer surface of the top wall of said casing in contact with the top ends of said current-carrying portions to form a shunt electric circuit with said fuse-forming link portion, said member having a high resistance with its color changed when exposed to high temperature caused by current flow through said resistance member when said link portion is open.

2. A plug-in fuse assembly according to claim 1, wherein said member is formed of a high-resistance metal plate having on its surface a heat responsive coat.

3. A plug-in fuse assembly according to claim 1, wherein said member is formed of a heat responsive semiconductor.

* * * * *